US008226885B2

(12) United States Patent
Ebner et al.

(10) Patent No.: US 8,226,885 B2
(45) Date of Patent: Jul. 24, 2012

(54) APPARATUS FOR BRACING OF SHEET-METAL JOINTS IN A HIGH-TEMPERATURE ANNEALING FURNACE

(75) Inventors: Peter Ebner, Leonding (AT); Brigitte Ebner, legal representative, Leonding (AT); Dieter Brandstaetter, Linz (AT)

(73) Assignee: EBNER Industrieofenbau GmbH, Leonding (AT)

( * ) Notice: Subject to any disclaimer, the term of this patent is extended or adjusted under 35 U.S.C. 154(b) by 21 days.

(21) Appl. No.: 12/735,088

(22) PCT Filed: Nov. 4, 2008

(86) PCT No.: PCT/AT2008/000396

§ 371 (c)(1),
(2), (4) Date: Jun. 15, 2010

(87) PCT Pub. No.: WO2009/076686

PCT Pub. Date: Jun. 25, 2009

(65) Prior Publication Data

US 2011/0057365 A1 Mar. 10, 2011

(30) Foreign Application Priority Data

Dec. 19, 2007 (AT) ..... A 2065/2007

(51) Int. Cl.
*C21B 3/00* (2006.01)

(52) U.S. Cl. ..... 266/274; 432/260

(58) Field of Classification Search ..... 266/274; 432/260

See application file for complete search history.

(56) References Cited

U.S. PATENT DOCUMENTS

| | | | | |
|---|---|---|---|---|
| 3,114,539 | A * | 12/1963 | Wilson et al. | 432/5 |
| 3,618,921 | A | 11/1971 | Corbett, Jr. | |
| 3,716,223 | A * | 2/1973 | Corbett, Jr. | 432/260 |
| 5,697,778 | A | 12/1997 | Hemsath | |

FOREIGN PATENT DOCUMENTS

| | | |
|---|---|---|
| DE | 1 219 059 | 12/1962 |
| DE | 100 16 096 | 9/2001 |
| EP | 0 307 474 | 3/1989 |
| GB | 918 356 | 2/1963 |
| JP | 04-224636 | 8/1992 |

OTHER PUBLICATIONS

International Search Report.

* cited by examiner

*Primary Examiner* — Scott Kastler
(74) *Attorney, Agent, or Firm* — Collard & Roe, P.C.

(57) ABSTRACT

An apparatus is described for bracing of sheet-metal joints (1) in a high-temperature annealing furnace having at least one carrier (2), which frontally receives a sheet-metal joint (1) and has a central axial passage opening (6), on which a support pipe (5), which axially penetrates the sheet-metal joint (1), having a carrier (2) for receiving a further sheet-metal joint (1) can optionally be placed in a load-bearing manner. In order to provide advantageous heating conditions, it is proposed that the carrier (2) has a ring body (7) forming the passage opening (6), having radially protruding carrier arms (8) distributed around the circumference.

4 Claims, 1 Drawing Sheet

APPARATUS FOR BRACING OF SHEET-METAL JOINTS IN A HIGH-TEMPERATURE ANNEALING FURNACE

CROSS REFERENCE TO RELATED APPLICATIONS

This application is the National Stage of PCT/AT2008/000396 filed on Nov. 4, 2008, which claims priority under 35 U.S.C. §119 of Austrian Application No. A 2065/2007 filed on Dec. 19, 2007. The international application under PCT article 21(2) was not published in English.

FIELD OF THE INVENTION

The invention relates to an apparatus for bracing sheet-metal joints in a high-temperature annealing furnace having at least one carrier, which frontally receives a sheet-metal joint and has a central axial passage opening, and on which a support pipe, which axially penetrates the sheet-metal joint, having a carrier for receiving a further sheet-metal joint can be placed in a load-bearing manner.

DESCRIPTION OF THE PRIOR ART

Transformer plates made of steel having a silicon proportion of 0.5-3.5 wt.-% are typically subjected to a high-temperature treatment in a hood furnace for technological reasons. The annealed material is heated up to 1200° C., essentially by radiant heat. The intrinsic strength of the annealed material decreases greatly at these high temperatures, so that the sheet-metal joints, which comprise coiled steel strips having a strip width of 1000 mm at a strip thickness of 0.3 mm, for example, are each supported on carriers. These carriers are formed by thick-walled disc bodies having a central, axial passage opening, if two sheet-metal joints are stacked one on top of another, the disc-shaped carrier for the upper sheet-metal joint being supported on the carrier for the lower sheet-metal joint, which typically rests on an annealing pedestal, in a load-bearing manner via a support pipe which penetrates the lower sheet-metal joint. While the radiant heat can be supplied largely unobstructed to the sheet-metal joints in the area of the upper front side and the outer turns, heating of the sheet-metal joints in the area of their lower front side is essentially only possible via the disc bodies of the carriers, which not only requires additional power for heating the disc bodies, whose weight can be up to one-third of the joint weight, but rather also results in uneven joint heating. In this context, it is to be considered that because of a minimum distance between the individual turns, the heat introduction results are better in the axial direction than in the radial direction, so that the outer turns are heated significantly more rapidly than the inner turns of the sheet-metal joints, with the result that the strip width and the diameter of the outer turns increases more rapidly as a result of the thermal expansion caused by the higher temperatures. Because of the temperature difference between the disc bodies receiving the sheet-metal joints and the strip turns, in particular in the outer diameter area, deformations of the turns in the contact area and, as a result thereof, welds may occur as a result of the decreased intrinsic strength of the sheet-metal joints. In order to provide a remedy here, the disc bodies of the carriers form conical surfaces which drop off outward, on which the sheet-metal joints rest, but only partial relief can be provided by this measure. The heat introduction into the sheet-metal joints in the area of their lower front side via the disc-shaped carriers additionally causes thermal tensions inside the disc bodies, which are accompanied by the danger of cracking and thus a loss of the load capacity of the carriers.

In order to be able to heat sheet-metal joints from the frontal contact surface with the aid of a heated gas stream, providing essentially radially running flow channels in the carriers, which receive the sheet-metal joints and have a central passage opening, which are permeated from the outside to the inside in order to withdraw the hot gas through the central axial passage opening of these carriers, is known (GB 918 356 A). For this purpose, ring-disc-shaped carriers are provided, which have radially running ribs on their upper and/or lower sides, between which the flow channels result. In order to avoid damage of the contacting front sides of the sheet-metal joints, the ribs widen radially outward in triangular form. Because the annealing material is almost exclusively heated by radiant heat in modern hood annealing furnaces, however, these known ring-disc-shaped carriers having flow channels between axially protruding ribs cannot provide a decisive improvement with respect to the heating of the sheet-metal joints.

Finally, providing ring-disc-shaped carriers having a support made of high-temperature-resistant bulk material for the careful support of sheet-metal joints to be subjected to a high-temperature treatment is known (DE 100 16 096 A1), so that differing thermal expansions of the sheet-metal joints may be readily absorbed via the loose bulk material. However, hardly any improvements are to be expected with respect to the uniform heating of the sheet-metal joints through this measure.

SUMMARY OF THE INVENTION

The invention is thus based on the object of implementing an apparatus of the type described at the beginning for bracing sheet-metal joints in a high-temperature annealing furnace in such a manner that the sheet-metal joints may be heated more uniformly to shorten the annealing times, the power required for heating the carriers of the sheet-metal joints is reduced, and the unavoidable tensions due to the heating of the carriers are kept within permissible limits, in order to be able to extensively prevent cracking.

The invention achieves the stated object in that the carrier has a ring body, which forms the passage opening, having radially protruding carrier arms distributed around the circumference.

Because of the radially protruding carrier arms distributed around the circumference of the ring body, space remains between these carrier arms for direct engagement of the radiant heat on the sheet-metal joints, so that the sheet-metal joints may also advantageously be heated from the lower front side. Because of the distribution of the carrier arms around the circumference of the ring body, the uniform bracing of the sheet-metal joints via their lower front side is not impaired. The more uniform and thus significantly more rapid heating of the sheet-metal joints is thus ensured without disadvantageous effect on the joint bracing. In contrast, the occurring thermal tensions are reduced and thus a danger of cracking is largely prevented by the radial carrier arms, which allow more uniform heating of the carriers. In addition, the weight of the carriers is reduced, which results in a corresponding reduction of the energy expenditure required for the carrier heating. It has thus been shown that with the aid of the proposed carrier, not only is more rapid heating of the annealing material to the required treatment temperature ensured with reduced energy introduction, but rather also the strain of the carriers due to thermal tensions is reduced and the load capacity of the carrier can thus be increased.

A particularly advantageous constructive design of the carriers results if the radial carrier arms form an I-profile in cross-section, which allows the adaptation to the particular loading conditions of these carriers through a corresponding web height, in order to be able to ensure a sufficient resistance torque for the load bearing.

The contact surfaces of the carrier arms which receive the sheet-metal joints may lie in a way known per se on a conical surface which drops off radially outward, in order to consider more rapid heating of the outer joint turns with respect to the axial and radial thermal expansions in spite of the proposed measures.

If the carrier is implemented as symmetrical to an axis-normal central plane, such a carrier can be used to receive sheet-metal joints on both front sides, which lengthens the lifetime of such carriers, if the contact surface for the sheet-metal joints no longer meets the requirements on one side, so that frontal joint damage may also be prevented over longer periods of use.

BRIEF DESCRIPTION OF THE DRAWING

The object of the invention is shown for exemplary purposes in the drawing. In the figures.

DESCRIPTION OF THE PREFERRED EMBODIMENT

Figure 1:
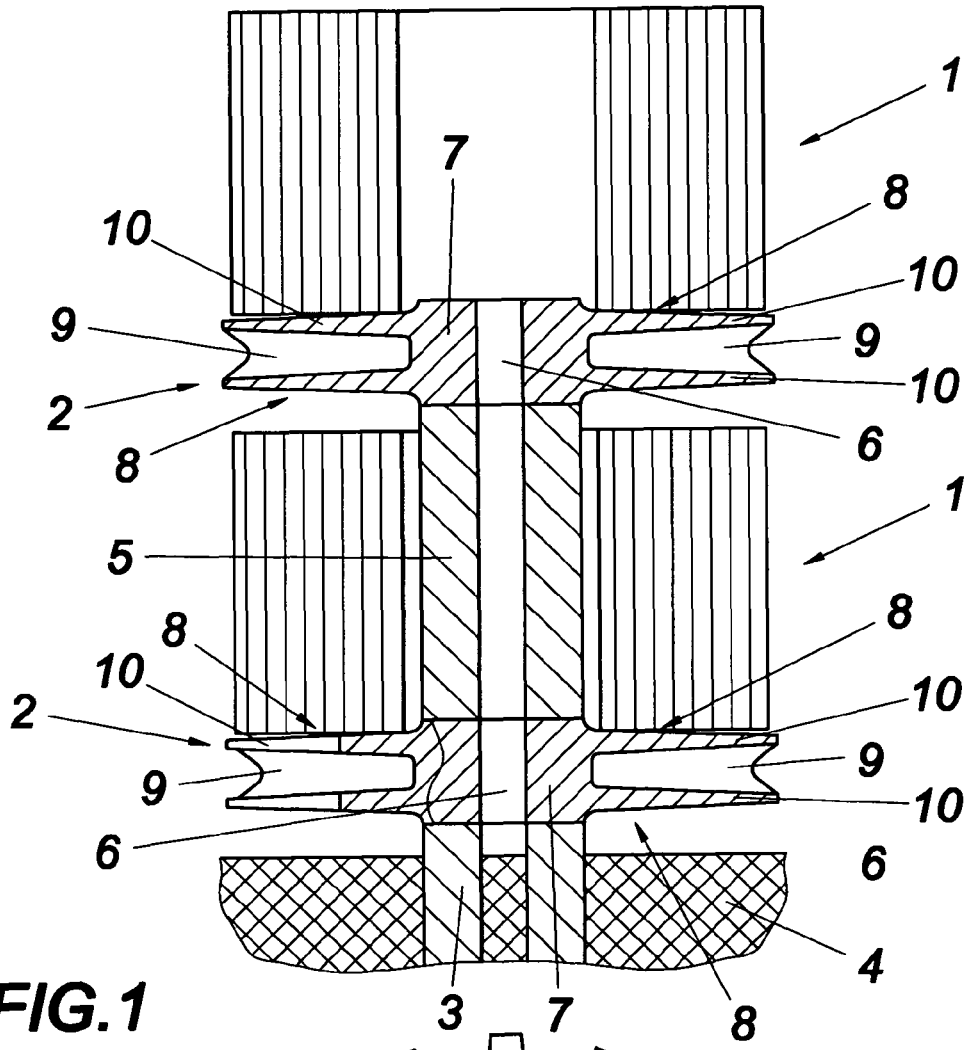
FIG. 1 shows an apparatus according to the invention for bracing sheet-metal joints in a high-temperature annealing furnace in a schematic axial section and FIG. 2 shows a carrier for receiving a sheet-metal joint in a partially cutaway top view.
Figure 2:
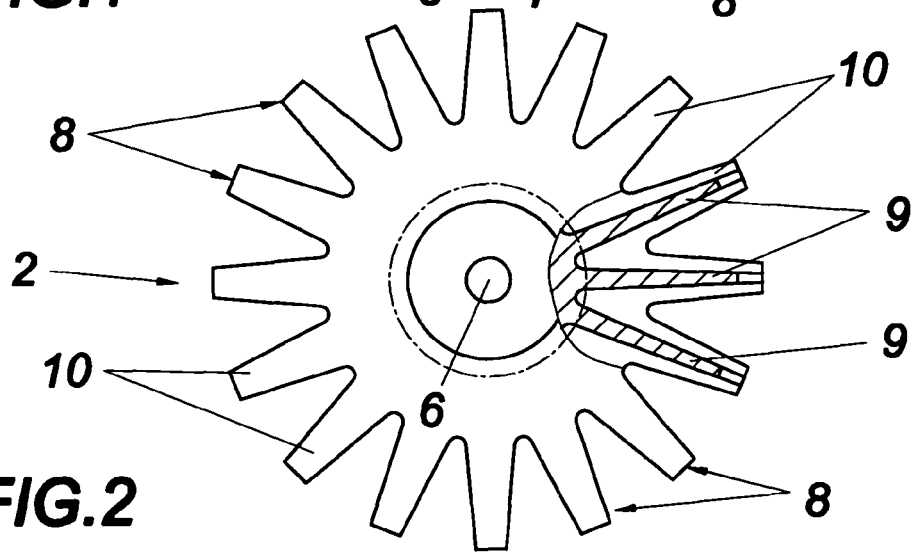

As can be inferred from FIG. 1, the sheet-metal joints 1 to be subjected to a high-temperature treatment are each supported per se on a carrier 2. The configuration is made so that the carrier 2 for the lower sheet-metal joint 1 rests on a support pipe 3 of the annealing pedestal 4 of a high-temperature annealing furnace in the form of a hood furnace. The carrier 2 for the upper sheet-metal joint 1, which is implemented in accordance with the carrier 2 for the lower sheet-metal joint 1, is supported in a load-bearing manner on the lower carrier 2 via a support pipe 5 which penetrates the lower sheet-metal joint 1, so that the lower sheet-metal joint 1 is freed of additional loads, like the upper sheet-metal joint 1, and is only loaded by the intrinsic weight. The carriers 2 each comprise a ring body 7 provided with a passage opening 6, which is provided with radial carrier arms 8 distributed around the circumference. These radial carrier arms 8 have a cross-section in the form of an I-profile, whose web is identified by 9. The resistance torque for the carrier arms 8 can advantageously be adapted to the particular load requirements via the web height, the weight of the carrier 2 remaining restricted. The flanges 10 of the carrier arms 8 implemented on both sides of the webs 9 form the contact surfaces for the sheet-metal joints 1 and rest on a conical surface which drops off radially outward, in order to consider the initially stronger thermal expansions of the outer turns of the sheet-metal joints 1 in the area of the outer turns both in the axial direction and also in the radial direction. Because of the symmetrical implementation of the carrier arms 8 with respect to an axis-normal central plane, the carriers 2 may receive the sheet-metal joints 1 on both sides, so that after corresponding wear of the contact surfaces in the area of the flanges 10 on one carrier side, the flanges 10 on the opposing carrier side may be used as the contact surface for the sheet-metal joints 1, if the carrier is turned by 180°.

As is immediately obvious from the drawing, the free spaces between the carrier arms 8 of the carriers 2 ensure direct heat supply to the lower front side of the sheet-metal joints 1, which allows more uniform and thus more rapid heating of the sheet-metal joints 1 to the high treatment temperature. In addition, a more uniform thermal strain results for the carriers 2 because of the radial carrier arms 8, which largely prevents thermal tensions resulting in cracks, so that greater joint weights may be received or carriers 2 having smaller dimensions may be used.

The invention claimed is:

1. An apparatus for bracing sheet-metal joints in a high-temperature annealing furnace, the apparatus having a first carrier frontally receiving a first sheet-metal joint, the first carrier having:

a central axial passage opening, and a ring body, the ring body forming the central axial passage opening and having radially protruding carrier arms distributed around a circumference of the ring body, wherein the apparatus further comprises:

a support pipe axially penetrating the first sheet metal joint and placed in a load-bearing manner on the first carrier, and a second carrier on the support pipe for reception of a second sheet-metal joint.

2. The apparatus according to claim 1, wherein the radially protruding carrier arms form an I-profile in cross-section.

3. The apparatus according to claim 1, wherein contact surfaces of the radially protruding carrier arms receive the first sheet-metal joint and lie on a conical surface, the conical surface dropping off radially outward.

4. The apparatus according to claim 1, wherein the carrier arms are symmetrically arranged with respect to an axis-normal central plane.

* * * * *